US010541066B2

(12) United States Patent
Sabo

(10) Patent No.: US 10,541,066 B2
(45) Date of Patent: Jan. 21, 2020

(54) CONDUCTIVE PLASTIC STRUCTURE

(71) Applicant: HP INDIGO B.V., Amstelveen (NL)

(72) Inventor: David Sabo, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/569,323

(22) PCT Filed: Jul. 27, 2015

(86) PCT No.: PCT/US2015/042289
§ 371 (c)(1),
(2) Date: Oct. 25, 2017

(87) PCT Pub. No.: WO2017/019023
PCT Pub. Date: Feb. 2, 2017

(65) Prior Publication Data
US 2018/0114608 A1 Apr. 26, 2018

(51) Int. Cl.

| | |
|---|---|
| ***H01B 1/24*** | (2006.01) |
| ***G03G 15/10*** | (2006.01) |
| ***G03G 15/06*** | (2006.01) |
| ***G03G 15/00*** | (2006.01) |
| ***H01B 3/42*** | (2006.01) |
| ***H01B 3/44*** | (2006.01) |
| ***H01R 4/30*** | (2006.01) |
| ***H01R 4/48*** | (2006.01) |

(52) U.S. Cl.
CPC ..... *H01B 1/24* (2013.01); *G03G 15/065* (2013.01); *G03G 15/10* (2013.01); *G03G 15/80* (2013.01); *H01B 3/426* (2013.01); *H01B 3/445* (2013.01); *H01R 4/30* (2013.01); *H01R 4/4809* (2013.01)

(58) Field of Classification Search
CPC ..... H01R 4/30; H01R 4/4809; H01B 1/24; H01B 3/426; H01B 3/445; G03G 15/065; G03G 15/10; G03G 15/80
USPC ..... 439/863, 289, 9, 11; 264/177.2; 310/246, 248, 252; 399/376
See application file for complete search history.

(56) References Cited

U.S. PATENT DOCUMENTS 3,234,420 A * 2/1966 Lindner ..... H01R 39/39 200/19.09
3,406,126 A * 10/1968 Litant ..... B29C 70/04 252/502
4,662,702 A * 5/1987 Furuya ..... H01R 13/03 439/630
4,839,114 A * 6/1989 Delphin ..... B29C 70/882 264/40.4

(Continued)

FOREIGN PATENT DOCUMENTS

CN 201156167 11/2008
DE 4139652 A1 * 6/1993 ..... B29C 70/025

(Continued)

*Primary Examiner* — Travis S Chambers
(74) *Attorney, Agent, or Firm* — HP Inc. Patent Department

(57) ABSTRACT

In one example, an electrically conductive structure includes an elongated substantially flat single piece of plastic permeated with conductive fibers including conductive fibers at a contact surface of the piece. The piece of plastic includes a bend that defines two contact surfaces angled with respect to one another near one end of the piece and a flexible stem between the two contact surfaces and the other end of the piece.

9 Claims, 4 Drawing Sheets

(56) References Cited

U.S. PATENT DOCUMENTS

| | | | | |
|---|---|---|---|---|
| 5,265,329 | A * | 11/1993 | Jones | H01R 13/2414 29/832 |
| 5,367,364 | A * | 11/1994 | Michlin | G03G 15/0216 361/221 |
| 5,778,286 | A | 7/1998 | Kido et al. | |
| 5,812,908 | A | 9/1998 | Larocca et al. | |
| 5,887,225 | A | 3/1999 | Bell | |
| 6,289,187 | B1 | 9/2001 | Swift et al. | |
| 6,490,426 | B1 * | 12/2002 | Zaman | F16D 1/10 399/117 |
| 6,615,006 | B2 | 9/2003 | Michlin et al. | |
| 7,266,322 | B2 | 9/2007 | Swift et al. | |
| 7,531,277 | B1 | 5/2009 | Facci | |
| 7,719,158 | B2 * | 5/2010 | Angerpointner | H01R 39/24 310/239 |
| 2010/0279086 | A1 | 11/2010 | Park et al. | |

FOREIGN PATENT DOCUMENTS

| | | |
|---|---|---|
| EP | 2063466 | 5/2009 |
| JP | 2003050512 | 2/2003 |

* cited by examiner

CONDUCTIVE PLASTIC STRUCTURE

BACKGROUND

Liquid electro-photographic (LEP) printing uses a special kind of ink to form images on paper or other printable media. The LEP printing process involves placing an electrostatic charge pattern of the desired printed image on a photoconductor and developing the image by applying a thin layer of ink to the charged photoconductor. Charged particles in the ink cause the ink to adhere to the pattern of the desired image on the photoconductor. The ink pattern is transferred from the photoconductor to an intermediate transfer member and then from the intermediate transfer member to the paper. Ink is applied to the photoconductor with a "developer" roller. The developer roller is part of a unit with rollers and electrodes that use electric fields to form an ink layer on the developer roller which is then transferred to the photoconductor. Voltage is applied to each of the rotating rollers through a contact to stationary elements in the unit that are connected to a power supply.

DRAWINGS

The same part numbers designate the same or similar parts throughout the figures.

DESCRIPTION

Currently, electrical contact with the developer rollers in LEP printers is made with a graphite or carbon/copper sintered brush that is spring loaded against the end of the roller. Brushes are susceptible to wear that can result in poor electrical contact. Also, the multiple pieces of a brush type contact increase complexity and cost. A new conductive structure has been developed for the electrical contact to the rollers in an LEP developer unit to help increase the reliability of the contact and to simplify assembly and lower cost. In one example, the new contact is an electrically conductive substantially flat single piece of plastic permeated with carbon fibers, including carbon fibers exposed at the contact surfaces of the piece. The mechanical properties of the carbon filled plastic and the ability to mold complex shapes enables a single piece that is deflected in the developer unit to provide a contact force against the end of the roller. The use of short, randomly oriented carbon fibers, for example, helps ensure good surface conductivity (i.e., low resistivity). In one specific implementation, polytetrafluoroethylene (PTFE) is added to the mix to improve durability and minimize wear.

This and other examples of the new conductive structure are not limited to developer rollers for LEP printing but may be implemented in other environments and for other applications. The examples shown and described herein illustrate but do not limit the scope of the patent, which is defined in the Claims following this Description.

Figure 1:
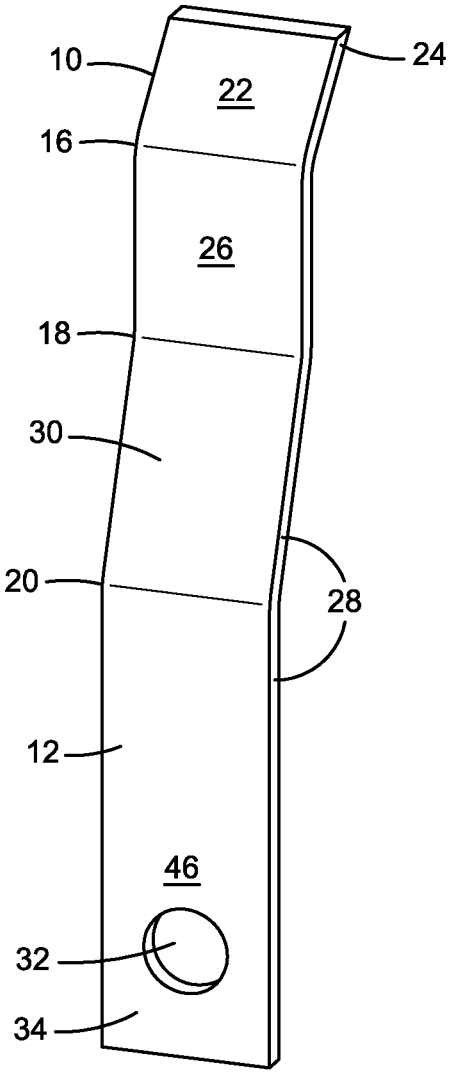
FIGS. 1 and 2 are front side and back side isometrics illustrating one example of a conductive plastic structure that can be used as an electrical contact to a roller.
Figure 2:
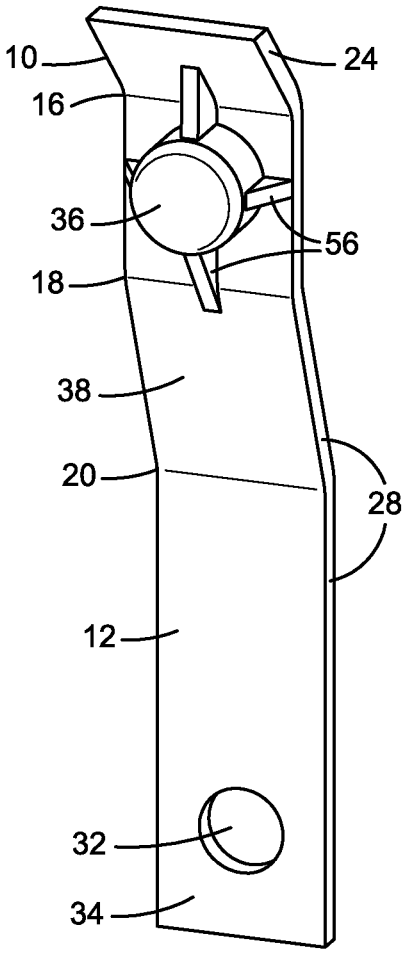
Figure 3:
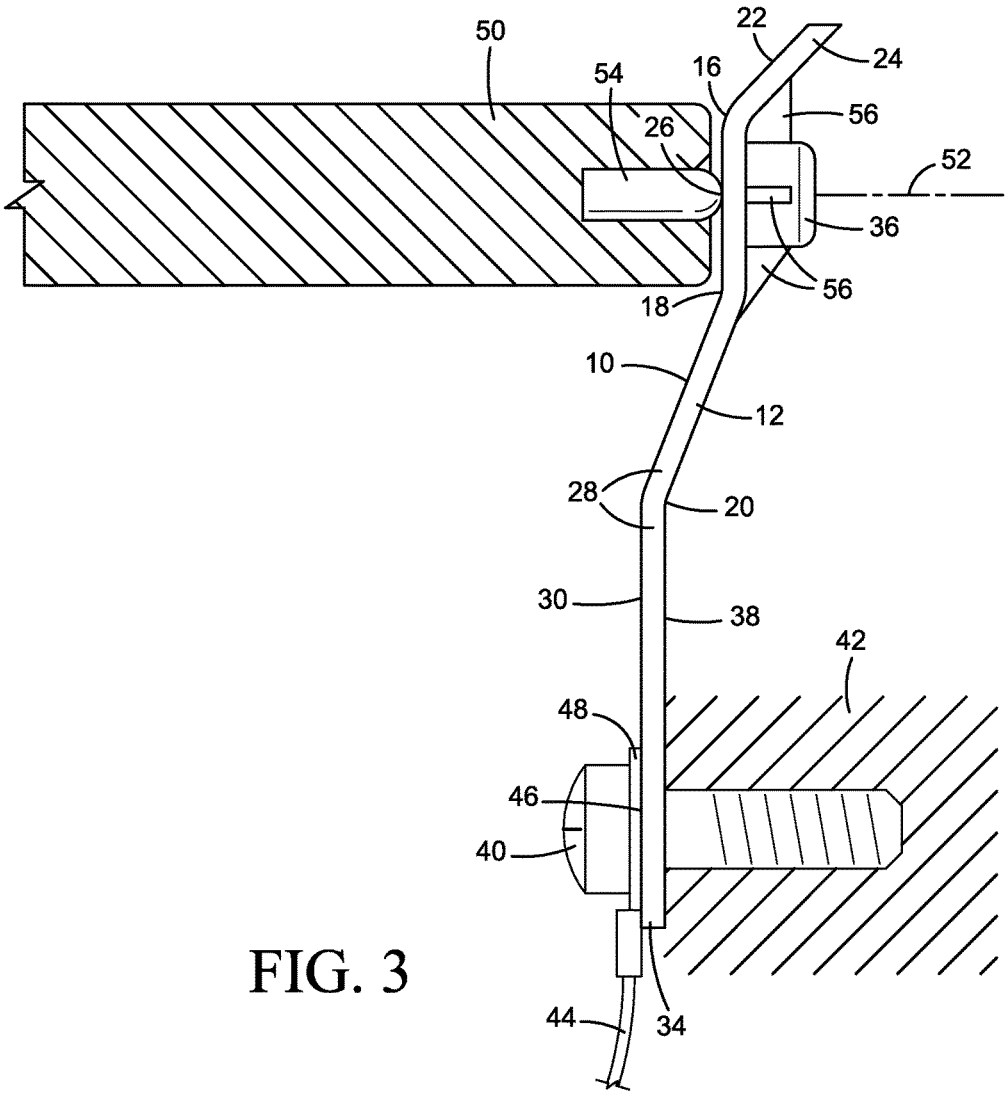
FIG. 3 is a side elevation and partial section showing one example of the conductive structure of FIGS. 1 and 2 implemented as an electrical contact to a roller.
Figure 4:
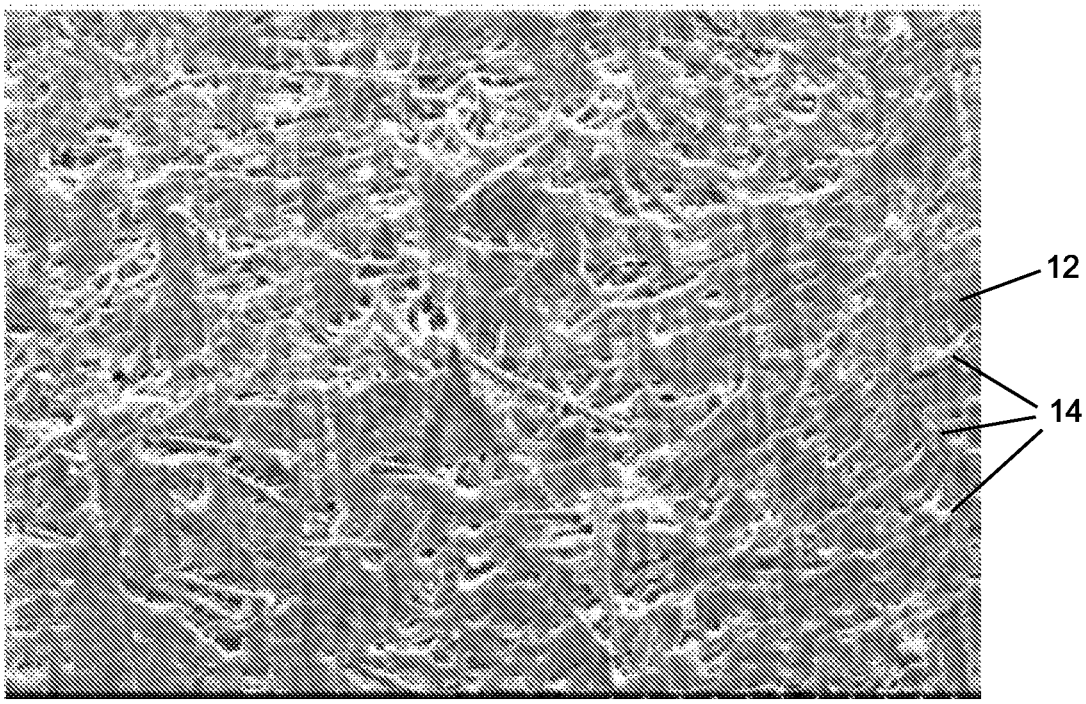
FIG. 4 is a microscopic photograph illustrating the surface for one example of a plastic mix forming the conductive structure of FIGS. 1 and 2.

FIGS. 1 and 2 are front side and back side isometrics illustrating one example of a conductive plastic structure 10 that can be used as an electrical contact to a rotating member. FIG. 3 is a side elevation and partial section showing structure 10 installed as an electrical contact to a roller. FIG. 4 is a microscopic photograph illustrating the surface of conductive structure 10 in FIGS. 1-3. Referring to FIGS. 1-4, structure 10 is a single elongated substantially flat piece 12 of flexible plastic permeated with randomly oriented conductive carbon fibers 14. Carbon fibers 14 are visible in the photograph of FIG. 4. In this example, piece 12 includes bends 16, 18, and 20. Bend 16 makes the transition from a lead-in surface 22 at one end 24 of piece 12 to a contact surface 26. Bend 18 makes the transition from contact surface 26 to a stem 28 region of piece 12.

Piece 12 in FIGS. 1-3 may be injection molded or otherwise formed as a monolithic structure from a uniform mix of plastic and carbon fibers so that carbon fibers 14 will be exposed at all surfaces of the piece. Thus, FIG. 4 illustrates carbon fibers 14 at any surface location of piece 12. Each surface 22, 26 represents a region on the front side 30 of piece 12 to perform the respective function, as described below with reference to FIGS. 5-8. Carbon fibers 14 are present at all surfaces of piece 12, specifically including contact surfaces 22 and 26.

In this example, structure 10 also includes a hole 32 in the other end 34 of piece 12 and a boss 36 protruding from back side 38 behind contact surface 26. Referring specifically to FIG. 3, a screw or other fastener 40 extends through hole 32 to fasten conductive structure 10 to a chassis 42. A wire or other stationary conductor 44 is connected to conductive structure 10 at a second contact surface 46 surrounding hole 32, for example with a ring terminal 48.

Structure 10 makes contact with a conductive roller 50 at surface 26. In this example, structure 10 contacts the end of roller 50 along the roller's axis or rotation 52. Also in this example, contact is made with roller 50 at surface 26 through a pin 54 inserted in the end of roller 50. As described in more detail below with reference to FIGS. 5-7, stem 28 is flexed in the position shown in FIG. 3 to exert a contact force against roller 50 (through pin 54 in this example) and boss 36 forms a localized thicker region at contact surface 26 to maintain good contact even as piece 12 wears against a rotating pin 54. The parts of piece 12 at lead-in surface 22 and contact surface 26 may be buttressed against boss 36 with buttresses 56 to stiffen each surface 22, 26 against undesired flex.

The plastic mix used to make a conductive structure 10 includes a sufficiently high carbon content for low bulk resistivity to help minimize the voltage drop across piece 12. Testing indicates that a carbon content of at least 30% by weight for carbon fibers should be adequate to deliver sufficiently low bulk resistivity for a good electrical connection at voltage differences in the range of 100 to 700, commonly found in a developer unit in an LEP printer. The plastic mix is formulated and processed to place carbon fibers at the surface of piece 12 for low surface resistivity to help deliver reliable electrical contact at surfaces 26 and 46.

Testing indicates that if the plastic flows too easily during injection molding, characteristic of a nylon 6 plastic mix for example, then a film with few or no carbon fibers can form on the surfaces of the part, significantly increasing surface resistivity even though bulk resistivity remains low. Accordingly, a less easy flowing plastic, a polycarbonate mix for example, may be desirable to help ensure the carbon fibers are exposed at the surface of the part for sufficiently low surface resistivity. Also, structure 10 may be "lubricated" to lower friction and wear at contact surface 26 by adding polytetrafluoroethylene (PTFE) to the mix. Thus, in one example, plastic piece 12 is injection molded with a polycarbonate mix that includes at least 30% by weight carbon fibers and at least 10% by weight polytetrafluoroethylene (PTFE). Other mixes are possible. For example, it may be possible to develop sufficiently low bulk and surface resistivity and still maintain adequate wear resistance using other plastics and/or other conductive additives.

Figure 7:
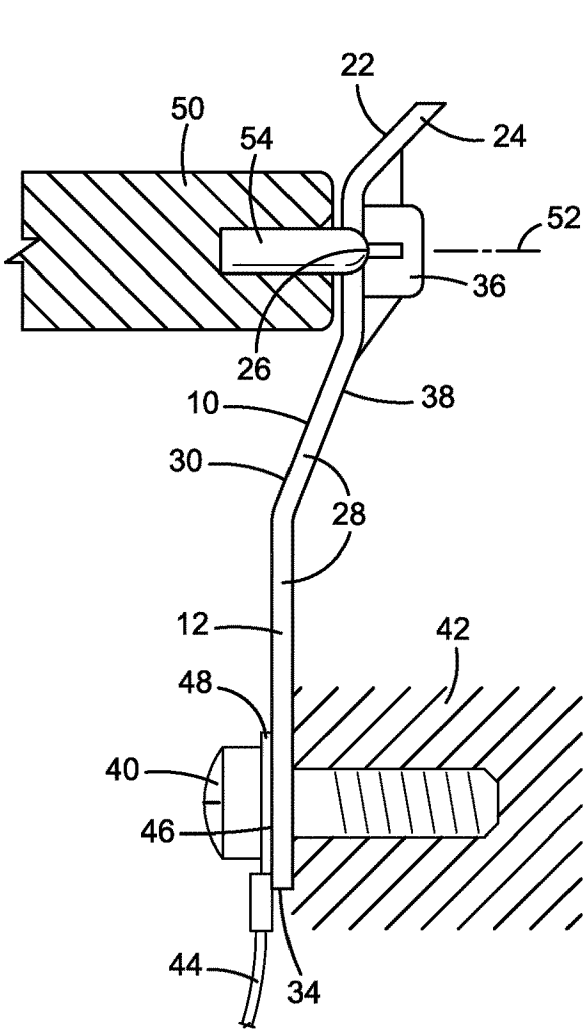
FIGS. 5-7 are side elevation and partial sections illustrating the assembly of FIG. 3 with the example conductive structure in different positions contacting the roller.
Figure 6:
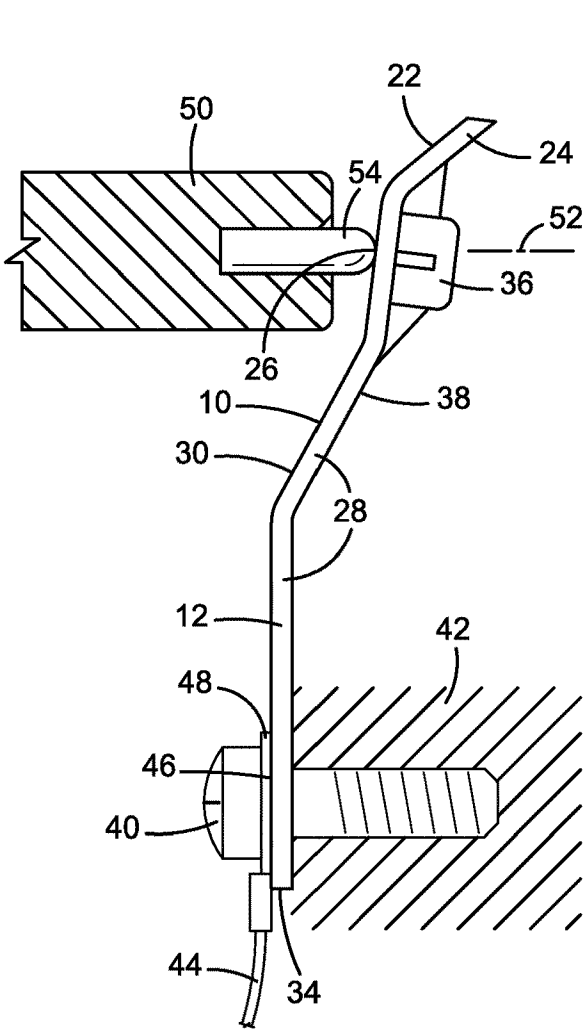
Figure 5:
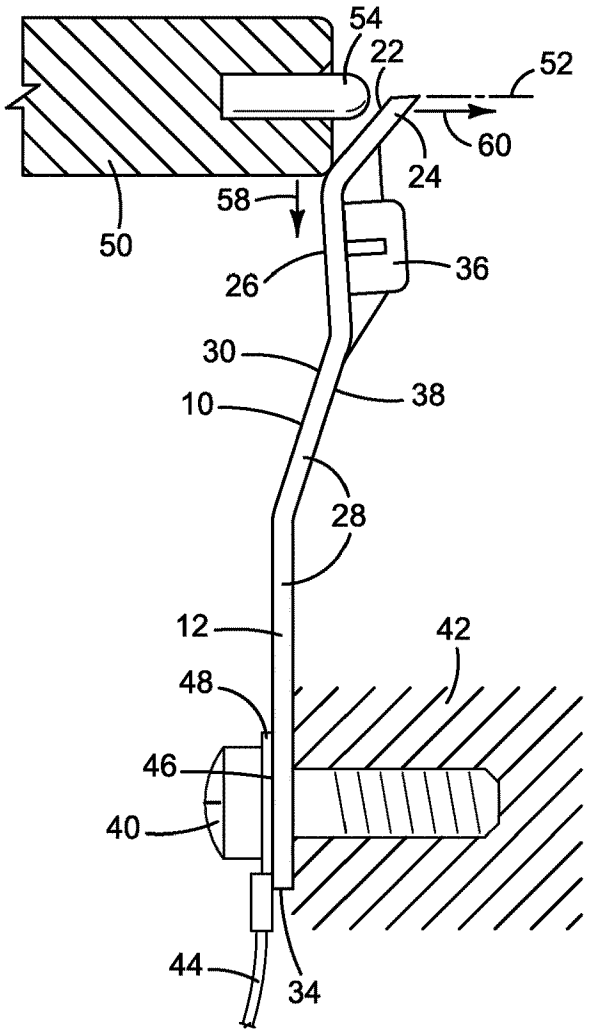

FIGS. 5-7 are side elevation and partial sections illustrating structure 10 in different positions to engage a roller 50 along its axis of rotation 52. In FIG. 5, roller 50 is being pressed down against lead-in surface 22, as indicated by direction arrow 58, for example to install a roller 50 in a developer unit in an LEP printer. Roller 50 moving down in the direction of arrow 58 displaces the end 24 of piece 12, as indicated by direction arrow 60 in FIG. 5, to flex stem 28, generating a contact force against the end of the roller (at pin 54).

In FIG. 6, roller 50 has reached the installed position with surface 26 contacting pin 54 at the urging of a flexed stem 28. Thus, piece 12 forms a cantilever flat spring at stem 28 to exert a contact force against the end of roller 50 along axis 52 at surface 26.

In FIG. 7, the friction between a rotating roller 50 (at pin 54) and contact surface 26 has worn through a portion of the thickness of piece 12. The thicker region formed by boss 36 absorbs the wear to maintain good contact between the receding surface 26 and roller 50 (at pin 54).

To help illustrate the flexibility of the new conductive structure, piece 12 in FIGS. 1-7 is formed in a complex shape specifically to replace an existing metal brush type contact used in the developer units in an LEP printer. Other configurations may be implemented and/or in other applications. A single molded piece of conductive plastic with low surface resistivity enables different shapes for a variety of implementations and applications as an electrical contact. Thus, the examples shown in the figures and described above illustrate but do not limit the scope of the patent. Other examples are possible. The foregoing description should not be construed to limit the scope of the following Claims.

"A" and "an" as used in the Claims means at least one.

The invention claimed is:

1. An electrically conductive structure, comprising an elongated substantially flat piece of plastic permeated with conductive fibers including conductive fibers exposed at a contact surface of the piece of plastic, the piece of plastic including:

a first end and a second end opposite the first end;

a bend connecting two surfaces angled with respect to one another on a front side of the piece of plastic near the first end;

a flexible stem between the two surfaces and the second end; and a boss protruding from a back side of the piece of plastic at a location of one of the two surfaces;

wherein the piece of plastic is permeated with randomly oriented conductive carbon fibers including conductive carbon fibers exposed at all surfaces of the piece, is a single piece of plastic made of a mix of polycarbonate, polytetrafluoroethylene and carbon fibers, and includes at least 30% by weight of carbon fibers and at least 10% by weight of polytetrafluoroethylene.

2. The structure of claim 1, where the piece of plastic includes a through hole near the second end and the stem is between the hole and the boss.

3. The assembly of claim 1, where the piece of plastic comprises a single piece of plastic molded polycarbonate mixed with polytetrafluoroethylene and randomly oriented conductive carbon fibers.

4. An electrically conductive plastic cantilever comprising a single flexible piece of plastic mixed with randomly oriented conductive carbon fibers exposed at an electrical contact surface of the piece of plastic, wherein the piece of plastic includes a localized thicker region at a location where the carbon fibers are exposed and the cantilever will contact a rotating part.

5. The cantilever of claim 4, where the piece of plastic is made of a mix of polycarbonate and carbon fibers.

6. The cantilever of claim 5, where the piece of plastic includes at least 30% by weight of carbon fibers.

7. An assembly, comprising:

a conductive roller having an axis of rotation;

a stationary conductor; and an electrically conductive flexible piece of plastic connecting the stationary conductor to the roller, the piece of plastic comprising molded plastic mixed with randomly oriented conductive carbon fibers exposed at all surfaces, the piece of plastic being flexed and including a localized thicker region to provide a contact force against one end of the roller along the axis of rotation.

8. The assembly of claim 7, where the piece of plastic comprises a single piece of molded plastic.

9. The assembly of claim 8, where the piece of plastic comprises a single piece of molded plastic mixed with polytetrafluoroethylene and randomly oriented conductive carbon fibers.

* * * * *